US006196306B1

(12) United States Patent
Aikawa et al.

(10) Patent No.: US 6,196,306 B1
(45) Date of Patent: Mar. 6, 2001

(54) LAMINATION TYPE HEAT EXCHANGER WITH PIPE JOINT

(75) Inventors: Yasukazu Aikawa, Nagoya; Tomohiko Nakamura, Obu, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/277,320

(22) Filed: Mar. 26, 1999

(30) Foreign Application Priority Data

Mar. 30, 1998 (JP) ..... 10-084428

(51) Int. Cl.[7] ..... F28F 9/04; F28D 1/03

(52) U.S. Cl. ..... 165/178; 165/153; 165/176; 285/124.3

(58) Field of Search ..... 165/178, 153, 165/176; 62/515; 285/124.3, 124.5, 288.1, 289.1

(56) References Cited

U.S. PATENT DOCUMENTS 5,042,577 8/1991 Suzumura .
5,477,919 12/1995 Karube .
5,630,326 * 5/1997 Nishishita et al. ..... 165/153 X
5,979,542 * 11/1999 Inoue et al. ..... 165/153 X

FOREIGN PATENT DOCUMENTS 0 703 425 3/1996 (EP) .
63-96496 * 4/1988 (JP) .
5-196389 * 8/1993 (JP) .

* cited by examiner

*Primary Examiner*—Leonard Leo
(74) *Attorney, Agent, or Firm*—Harness, Dickey & Pierce, PLC

(57) ABSTRACT

A side refrigerant outlet passage and a side refrigerant inlet passage are provided between first and second protruding portions of a side plate and an end plate, which are joined to one another. The side plate has base portions protruding in an opposite direction of the end plate, and a pipe joint including an outlet pipe and an inlet pipe is joined to the base portions of the side plate. Accordingly, a strength of joining portions between the side pate and the pipe joint is improved, and simultaneously processing cost of the pipe joint is decreased.

6 Claims, 15 Drawing Sheets

LAMINATION TYPE HEAT EXCHANGER WITH PIPE JOINT

CROSS REFERENCE TO RELATED APPLICATION

This application is based upon and claims the benefit of Japanese Patent Application No. 10-84428, filed on Mar. 30, 1998, the contents of which are incorporated herein by reference.

BACKGROUND OF THE INVENTION

1. Field of the Invention

This invention relates to a lamination type heat exchanger suitable for an evaporator of an automotive air conditioner and including a lamination structure of metallic plates for forming fluid passages, and a pipe joint that is disposed at an end of the lamination structure in a lamination direction for providing fluid outlet and inlet portions.

2. Description of the Related Art

Recently, a refrigerant evaporator for an automotive air conditioner has been required to include a pipe joint that is disposed at a side central portion of a heat exchanging part for a refrigerant pipe arrangement. This pipe arrangement has high flexibility, because a pipe can be directly taken out from the side of the heat exchanging part, and the position where the pipe is taken out can be arbitrarily selected within the side region of the heat exchanging part.

The applicant of the present invention proposed a lamination type evaporator in a preceding pending Japanese Patent Application No. 9-257095. In the evaporator, an inlet tank portion for distributing refrigerant into refrigerant passages in a heat exchanging part is positioned at an end in refrigerant flow direction of the heat exchanging part, and an outlet tank portion for receiving the refrigerant that passes through the heat exchanging part is positioned at the other end in the refrigerant flow direction of the heat exchanging part. A side refrigerant inlet passage for conducting refrigerant into the inlet tank portion and a side refrigerant outlet passage into which refrigerant flows from the outlet tank portion are provided at a side of the heat exchanging part (at an end in a lamination direction of metallic thin plates).

The side refrigerant inlet passage is connected to a refrigerant inlet portion of a pipe joint, while the side refrigerant outlet passage is connected to a refrigerant outlet portion of the pipe joint. Specifically, the side refrigerant inlet passage and the side refrigerant outlet passage are defined by an end plate and a side plate that are positioned at the side of the heat exchanging part (at the end in the lamination direction of the metallic thin plates). The pipe joint is joined to the side plate. In the preceding application, however, when an external refrigerant pipe is connected to the pipe joint, force is externally applied to the joining (brazing) portion between the pipe joint and the side plate, thereby generating excessive stress in the joining portion. This excessive stress can decreases strength of the joining portion.

SUMMARY OF THE INVENTION

The present invention has been made in view of the above problem. An object of the present invention is to improve a strength against external force at a joining portion between a side plate and a pipe joint at low cost.

According to a first aspect of the present invention, a lamination type heat exchanger includes side outlet and inlet passages, which are provided between an end plate and first and second protruding portions of a side plate, and a pipe joint that includes a fluid outlet and a fluid inlet respectively communicating with the side outlet and inlet passages. The first and second protruding portions further has first and second base portions embossing from the first and second protruding portions toward an opposite side of the end plate in a lamination direction of metallic thin plates, and an end face of the pipe joint is joined to the first and second base portions.

As a result, a joining area between the pipe joint and the side plate is secured, so that joining strength therebetween against external force is improved. In addition, because the base portions are formed on the side plate that is formed from a metallic thin plate, the base portions can be readily formed when the side plate is formed by pressing. On the other hand, the end face of the pipe joint can be made flat, so that the pipe joint can be readily formed by cold forging, resulting in low processing cost of the pipe joint.

According to a second aspect of the present invention, a side plate joined to an end plate includes first, second, and third members. The first member has strength that is larger than those of the second and third members, and the second and third members respectively have first and second protruding portions for forming with the end plate a side outlet passage and a side inlet passage. Specifically, the strength of the first member is increased by increasing a thickness of the first member more than the second and third members. Otherwise, the first member is made of material having a strength that is larger than those of the second and third members. As a result, the joining strength between the pipe joint and the side plate is secured. The end face of the pipe joint can be made flat, so that the pipe joint is readily formed by cold forging, resulting in low processing cost of the pipe joint.

Preferably, the pipe joint is composed of a joint body that is joined to the side plate, and outlet and inlet pipes, which are inserted into first and second through holes of the joint body. Accordingly, even if the outlet and inlet pipes have complicated configurations, the joint body separated from the pipes can be easily formed by cold forging.

BRIEF DESCRIPTION OF THE DRAWINGS

Other objects and features of the present invention will become more readily apparent from a better understanding of the preferred embodiments described below with reference to the following drawings.

DETAILED DESCRIPTION OF THE PREFERRED EMBODIMENTS

Figure 1:
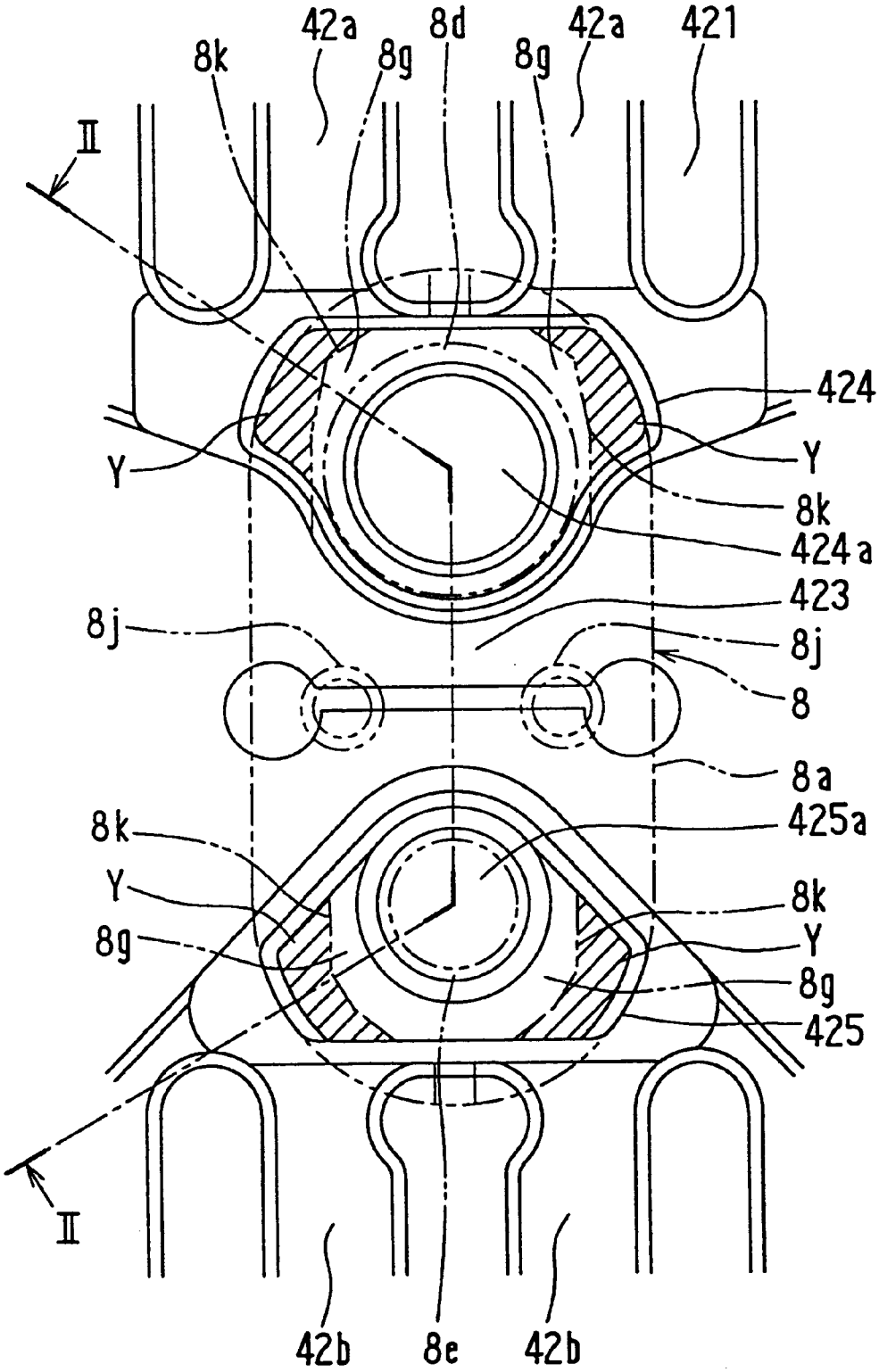
FIG. 1 is a plan view partially showing a side plate in a prototype formed by the inventors.
Figure 2:
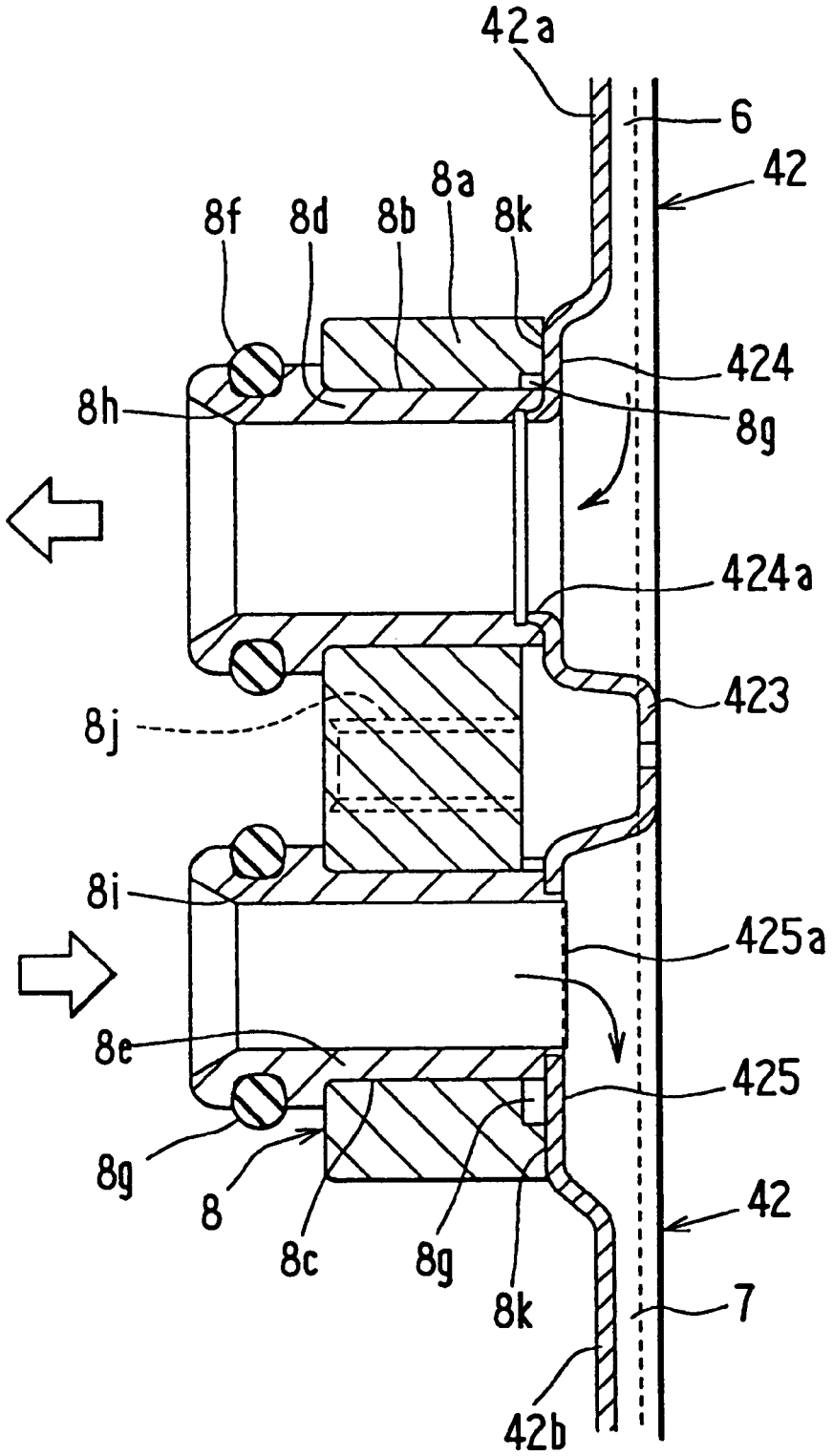
FIG. 2 is a cross-sectional view taken along a II—II line in FIG. 1, showing the side plate and a pipe joint joined to the side plate.

The inventors of the present invention manufactured a prototype joining structure shown in FIGS. 1 and 2 and studied it. In FIGS. 1 and 2, a side plate 42 is embossed to have protruding portions 42*a*, 42*b* protruding outwardly, thereby providing a side refrigerant outlet passage 6 and a side refrigerant inlet passage 7 therein. The side plate 42 further has sub-protruding portions 424, 425, which protrudes outwardly further from the protruding portions 42*a*, 42*b* at the central portion in the longitudinal direction of the side plate 42. Accordingly, refrigerant passage areas are enlarged, and pressure losses at generally right-angled corners of the passages are suppressed.

On the other hand, a pipe joint 8 is composed of a joint body 8*a* that is a generally elliptically shaped block member, and refrigerant outlet and inlet pipes 8*d*, 8*e* that are respectively inserted into through holes 8*b*, 8*c* of the joint body 8*a*. Incidentally, the block member is significantly thicker than the side plate 42, a thickness of which is approximately 1 mm, to secure sufficient strength. Because of this, the side plate 42 is formed from an aluminum plate into a specific shape by pressing, and to the contrary, the joint body 8*a* is formed from an aluminum member by cold forging or the like.

In this structure, joining deficiency between the refrigerant outlet and inlet pipes 8*d*, 8*e* and the side plate 42 easily causes refrigerant leakage. Therefore, the refrigerant outlet and inlet pipes 8*d*, 8*e* must be securely joined (brazed) to the side plate 42. In practice, the brazing of the joint body 8*a* and the refrigerant inlet and outlet pipes 8*d*, 8*e* to the side plate 42 is carried out using brazing filler metal for an aluminum clad member constituting the side plate 42. When the refrigerant outlet and inlet pipes 8*d*, 8*e*, and the joint body 8*a* are brazed on the identical surface, however, the brazing filler metal is attracted to a side of the joint body 8*a* that has a large area to be brazed by a surface tension thereof, resulting in shortage of the brazing filler metal for the joining portions at the side of the refrigerant outlet and inlet pipes 8*d*, 8*e*. As a result, brazing deficiency occurs at the side of the refrigerant outlet and inlet pipes 8*d*, 8*e*.

Therefore, in the prototype structure shown in FIGS. 1 and 2, the joint body 8*a* is formed with base portions 8*k* protruding toward the side plate side with a height of approximately 1.5 mm as joining faces (brazing faces) to the side plate 42. With this structure, the inventors tried to braze the joint body 8*a* to the side plate 42 in a state where the base portions 8*k* are brought to contact the side plate 24 by pressure. In FIG. 1, regions Y hatched with slant lines indicate the joining portions of the joint body 8*a* at the base portions 8*k*.

According to this prototype structure, recess portions (joining face interception part) 8*g* are provided between the joining portions of the joint body 8*a* and the joining portions of the refrigerant outlet and inlet pipes 8*d*, 8*e*. The recess portions 8*g* prevent the brazing filler metal from moving from the side of the refrigerant outlet and inlet pipes 8*d*, 8*e* to the side of the joint body 8*a*, so that the brazing filler metal is secured for the refrigerant outlet and inlet pipes 8*d*, 8*e* to improve brazing performance. Simultaneously, a sufficient joining area resistible to external force is secured by the base portions 8*k*.

In the prototype structure, however, it is necessary to form the complicated circular-like base portions 8*k*, which cannot easily be formed by cold forging. Therefore, the joint portion 8*a* is not formed only by cold forging, and cutting work must be carried out on the joint body 8*a* to form the base portions 8*k*, resulting in deterioration of workability and increased cost of the joint body 8*a*. Preferred embodiments of the present invention have been made to further improve these points.

First Embodiment

Figure 3:
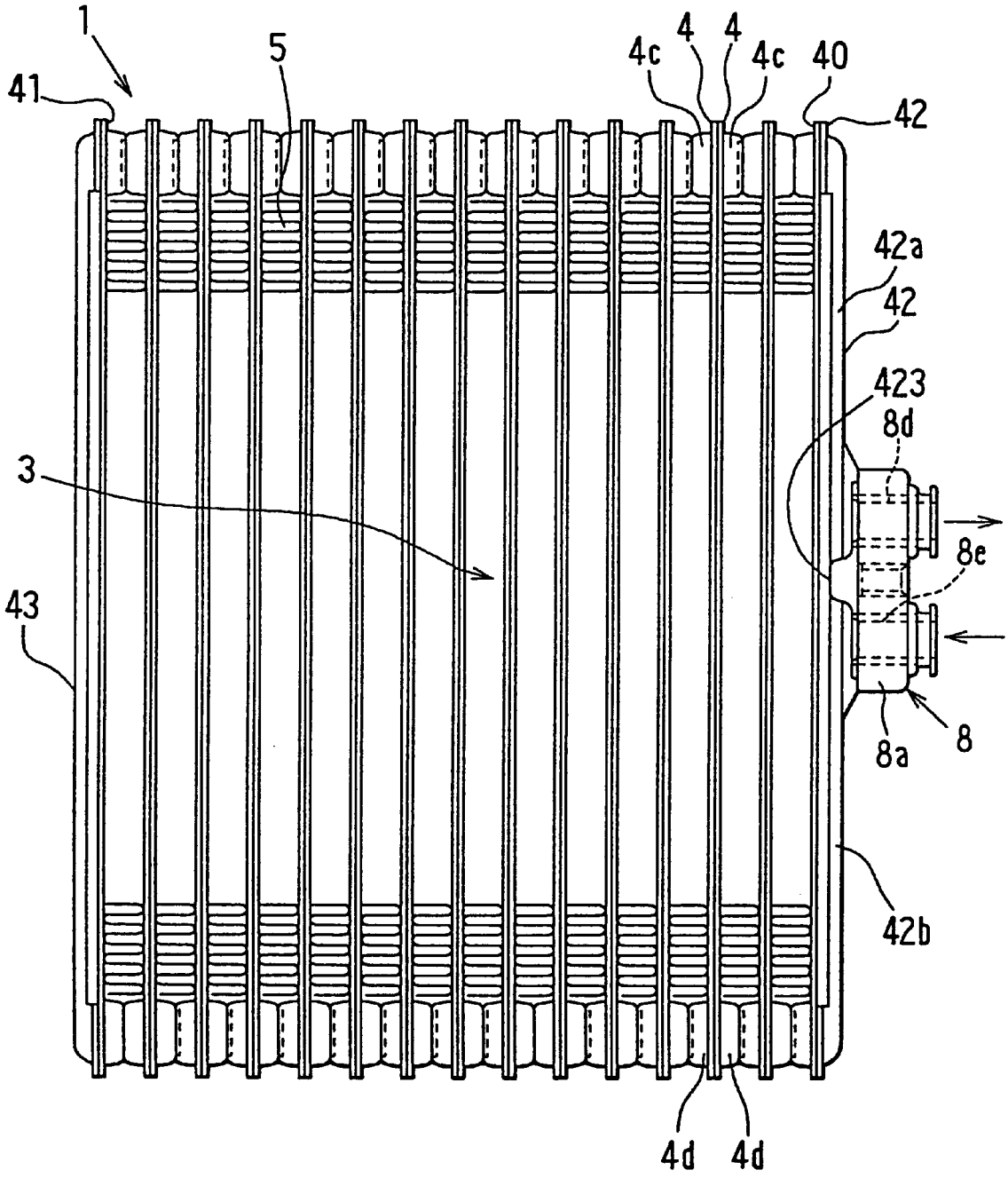
FIG. 3 is a front view showing an evaporator in a first preferred embodiment.
Figure 4:
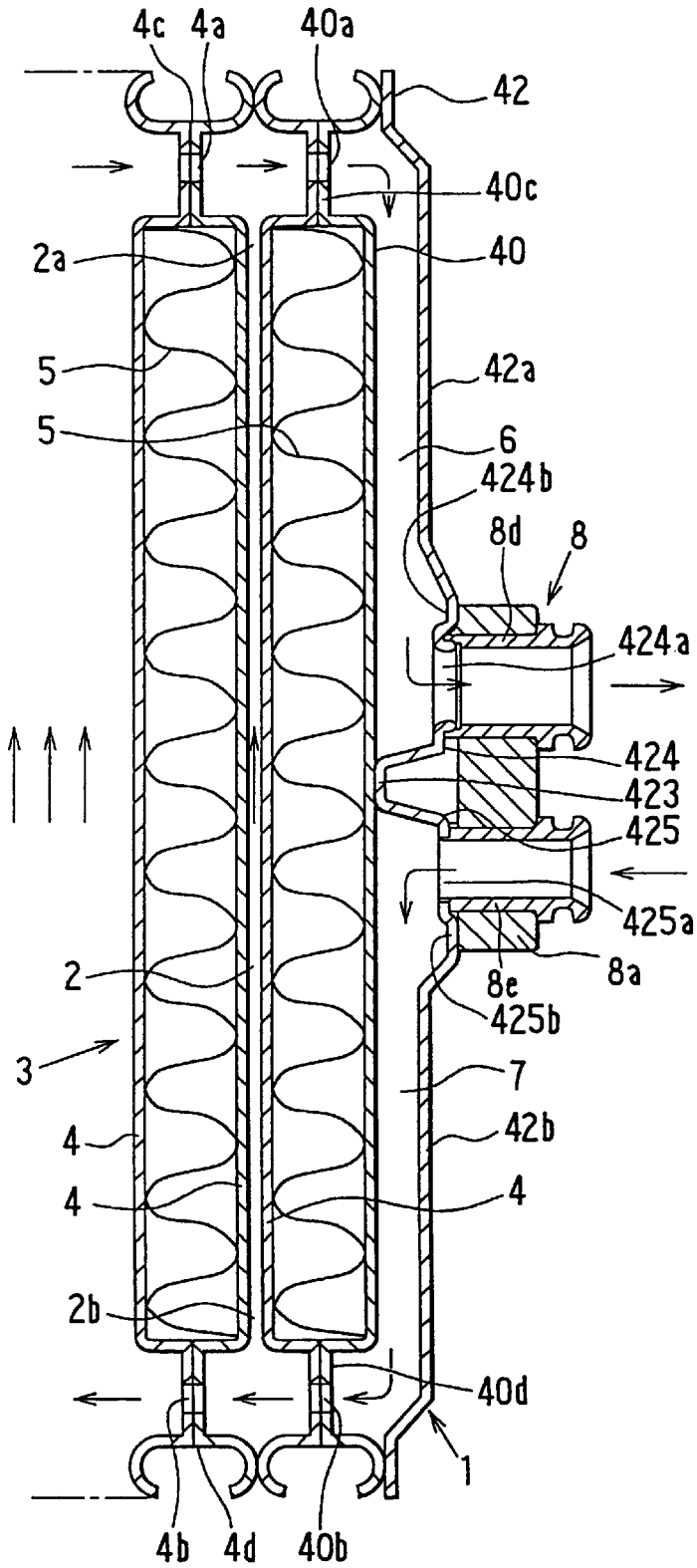
FIG. 4 is a cross-sectional view partially showing the evaporator shown in FIG. 3.

In a first preferred embodiment, the present invention is applied to a refrigerant evaporator 1 shown in FIGS. 3 and 4 in a refrigerating cycle for an automotive air conditioner. The evaporator 1 receives low-temperature low-pressure gas-liquid two-phase refrigerant that is decompressed by a thermostatic expansion valve (decompressing device) that is not shown.

As shown in FIGS. 3 and 4, the evaporator 1 includes plural refrigerant passages 2 arranged in parallel, and a heat exchanging part 3 for exchanging heat between refrigerant (inside fluid) flowing in the refrigerant passages 2 and conditioning air flowing outside the refrigerant passages 2. The heat exchanging part 3 has a lamination structure composed of metallic thin plates 4. Each of the metallic thin plates 4 is formed from a both-surface clad member (thickness : approximately 0.6 mm) into a specific shape. The both-surface clad member is composed of an aluminum core member (No. A3000 family material), both surfaces of which are clad with brazing filler metal (No. A4000 family material). The metallic thin plates 4 forms plural pairs. The plural pairs are laminated with and joined to one another by brazing, thereby providing the plural refrigerant passages 2 extending in parallel with one another.

The metallic thin plates 4 respectively have tank portions 4*c*, 4*d* with communication holes 4*a*, 4*b* on both ends thereof (on the upper and lower ends in FIG. 4). The refrigerant passages 2 communicate with one another through the tank portions 4*c*, 4*d*. Each of the tank portions 4*c*, 4*d* is a cup-like protruding portion protruding outwardly in the lamination direction of the metallic thin plates 4 (in the crosswise direction in FIGS. 3 and 4). In this embodiment, the tank portions 4*c* at one side constitute an outlet side tank portion in which refrigerant gathers after passing through the refrigerant passages 2, while the tank portions 4*d* at the other side constitute an inlet tank portion from which refrigerant is distributed into the refrigerant passages 2.

In the heat exchanging part 3, corrugated fins 5 are disposed between respective adjacent two of the refrigerant passages 2 at an outer surface side, and are joined thereto, thereby increasing a heat transfer area at an air side. Each of the corrugated fins 5 is formed into a specific shape from an aluminum bare member such as A3003 that is not clad with brazing filler metal. An end plate 40 is disposed at an end portion of the heat exchanging part 3 (at the right end portion in FIG. 4) in the lamination direction of the metallic thin plates 4, and a side plate 42 is joined to the end plate 40. Another end plate 41 is disposed at the other end portion (at the left end portion in FIG. 4) in the lamination direction described above, and another side plate 43 is joined to the end plate 41. Each of the plates 40–43 is composed of the both-surface clad member as well as the metallic thin plates 4, and has a thickness of, for instance, approximately 1 mm, which is thicker than that of the metallic thin plates 4, to have sufficient strength thereof.

The end plate 40 has tank portions 40*c*, 40*d* with communication holes 40*a*, 40*b* at both ends thereof. The tank portions 40*c*, 40*d* are also shaped into cup-like protrusions protruding outwardly in the metallic thin plate lamination direction. The communication hole 40*a* of the tank portion 40*c* at one side communicates with the outlet side tank portion 4*c* of the metallic thin plates 4, while the communication hole 40*b* of the tank portion 40*d* at the other side communicates with the inlet side tank portion 4*d*.

The side plate 43 at the left end portion in FIGS. 3 and 4 enhances rigidity of the heat exchanging part 3 and simultaneously provides a refrigerant passage (not shown) with the end plate 41. The constitution of the refrigerant passages including this refrigerant passage is disclosed in JP-A-9-170850, and the detailed explanation is omitted. The side plate 42 at the right end portion in FIGS. 3 and 4 is formed with first and second protruding portions 42*a*, 42*b* which protrude outwardly in the metallic thin plate lamination direction with rib-like shapes. The two protruding portions 42*a*, 42*b* are separated from one another at an approximately intermediate portion in the side plate longitudinal direction, and side refrigerant outlet and inlet passages 6 and 7 are provided in the spaces defined by the two protruding portions 42*a*, 42*b* and the end plate 40, respectively.

Figure 5:
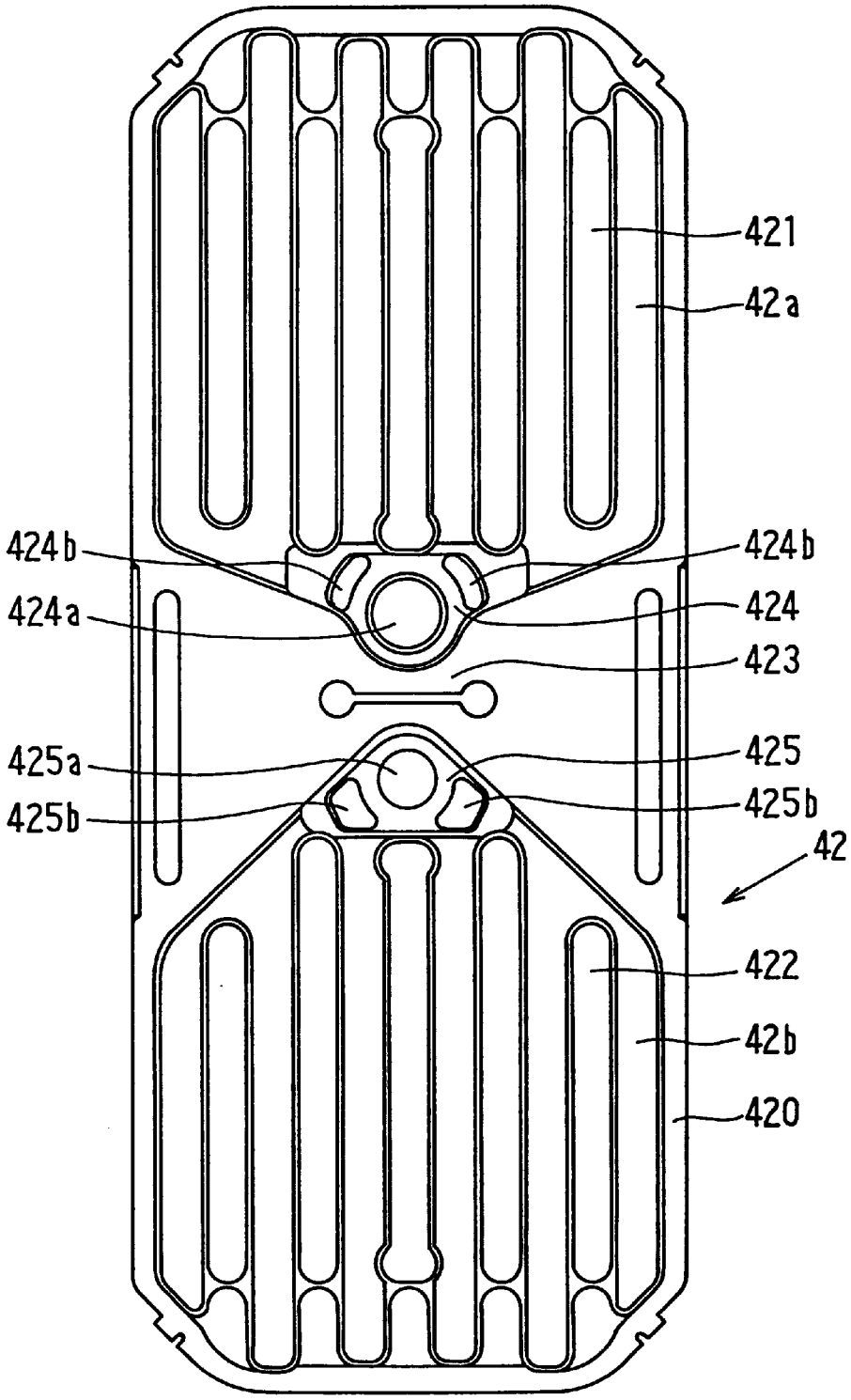
FIG. 5 is a plan view showing a side plate in the first embodiment.
Figure 6:
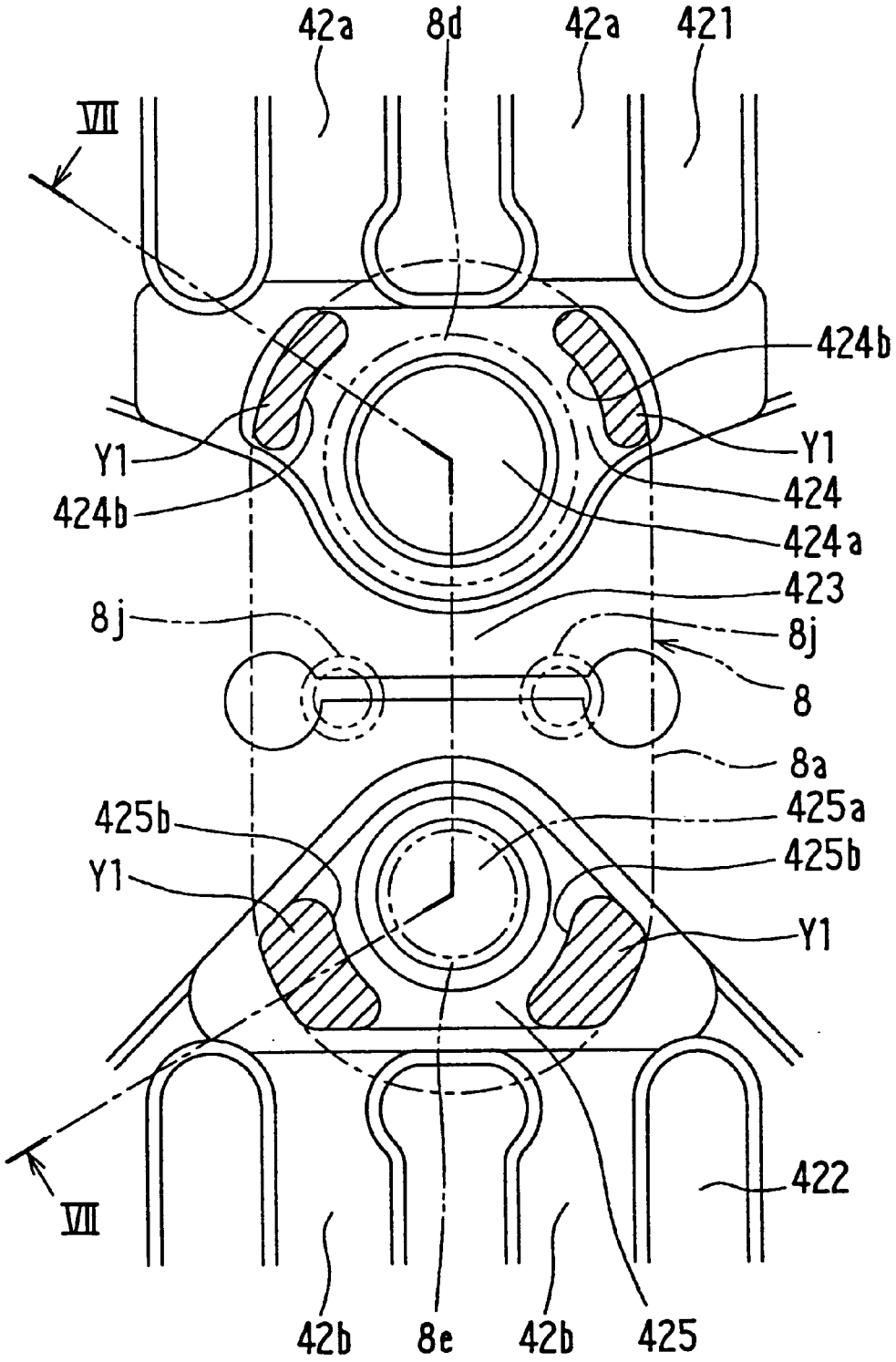
FIG. 6 is a partially enlarged view of the side plate shown in FIG. 5.
Figure 7:
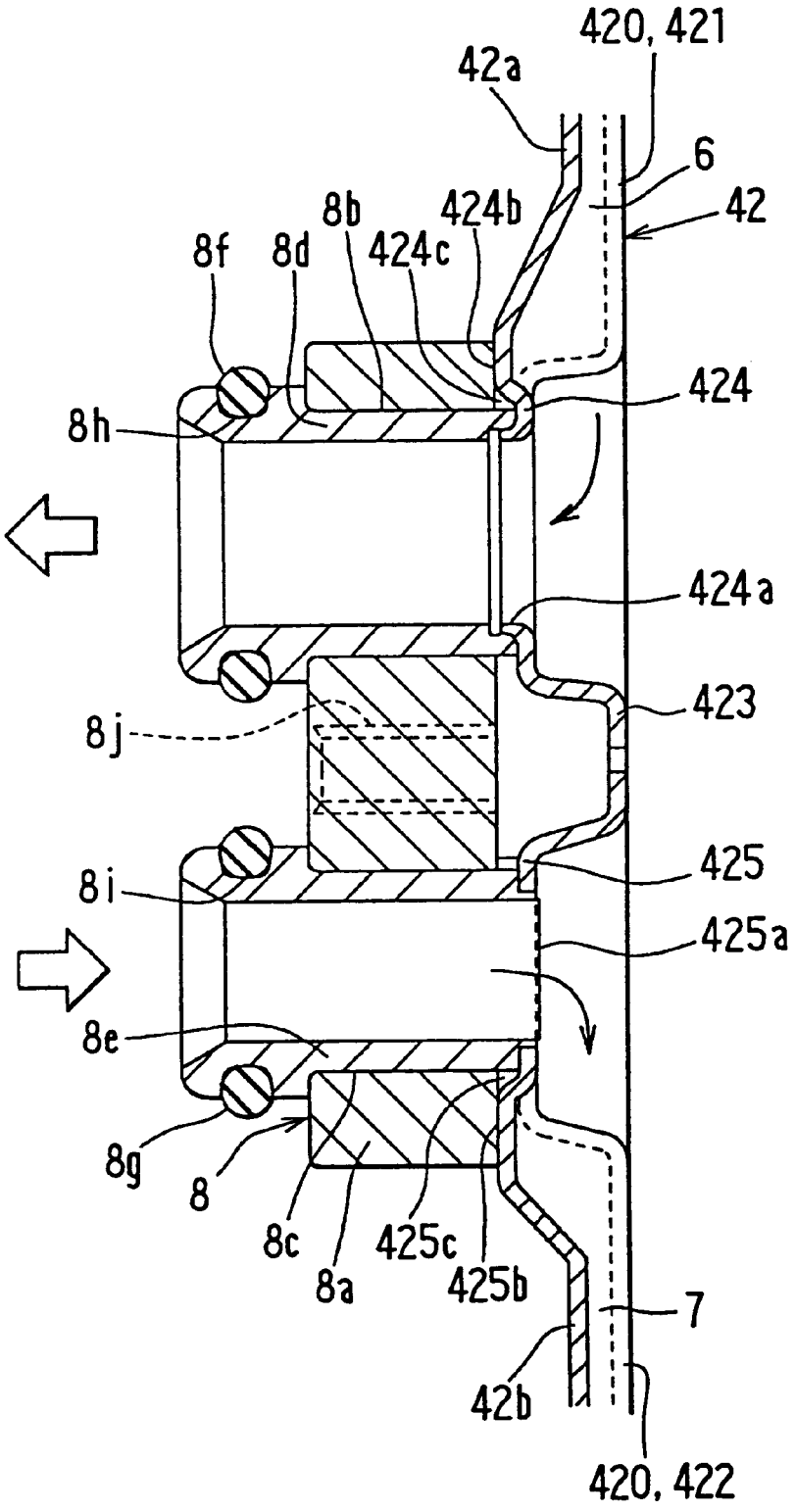
FIG. 7 is a cross-sectional view taken along a VII—VII line in FIG. 6, showing the side plate and a pipe joint joined to the side plate.

The side refrigerant outlet passage 6 communicates with outlet portions (upper end portions in FIG. 4) 2*a* of the respective refrigerant passages 2 through the tank portion 40*c* and the outlet side tank portion 4*c*. The side refrigerant inlet passage 7 communicates with inlet portions (lower end portions in FIG. 4) 2*b* of the refrigerant passages 2 through the tank portion 40*d* and the inlet side tank portion 4*d*. FIG. 5 shows the side plate 42 from a side of a pipe joint 8 described below (from an outside), and FIG. 6 is a partially enlarged view of FIG. 5 and indicates the pipe joint 8 with two-dot chain lines. FIG. 7 is a cross-sectional view taken along a VII—VII line in FIG. 6.

As shown in FIG. 5, the first and second protruding portions 42*a*, 42*b* of the side plate 42 are respectively divided into several (six in this embodiment) parts, and protrudes from a reference joining face (brazing face) 420 in parallel with the side plate longitudinal direction. The reference joining face (brazing face) 420 is a face that is to be brazed to the end plate 40, and corresponds to the face at the paper space back side in FIG. 5.

Reinforcement ribs 421, 422 are provided respectively between the divided parts of the first and second protruding portions 42*a*, 42*b* to serve as joining faces that are to be joined to the end plate 40. The top portions of the reinforcement ribs 421, 422 protrude in an opposite direction (in a back side direction of the paper space in FIG. 5) with respect to the top portions of the protruding portions 42*a*, 42*b*. The top portions of the reinforcement ribs 421, 422 are coplanar with the reference joining face 420 of the side plate 42.

As understood from the constitution described above, the side refrigerant outlet passage 6 and the side refrigerant inlet passage 7 are respectively composed of parallel passages defined by the divided parts of the protruding portions 42*a*, 42*b*, and are partitioned from one another by a partitioning joining face 423 that extends entirely in a width direction of the side plate 42 at the intermediate portion in the side plate longitudinal direction. The partitioning joining face 423 is also coplanar with the reference joining face 420.

Further, first and second sub-protruding portions 424, 425 are integrally formed at upper and lower sides of the partitioning joining face 423 to protrude outwardly in the lamination direction (in the right direction in FIG. 4) more than the top portions (protruding end faces) of the first and second protruding portions 42*a*, 42*b*. As shown in FIG. 4, an inside space of the first (upper side) sub-protruding portion 424 communicates with a downstream side end portion of the side refrigerant outlet passage 6 defined by the protruding portion 42*a*. An inside space of the second (lower side) sub-protruding portion 425 communicates with an upstream side end portion of the side refrigerant inlet passage 7 defined by the protruding portion 42*b*.

The first and second sub-protruding portions 424, 425 have circular opening portions 424*a*, 425*a*, respectively, at protruding end faces thereof for connecting inside and outside spaces thereof. The first and second sub-protruding portions 424, 425 further have base portions 424*b*, 425*b* that extend at relatively larger areas at outer circumference sides of the opening portions 424*a*, 425*a* on the protruding end faces. The base portions 424*a*, 425*a* are embossed by pressing. The base portions 424*b*, 425*b* has generally arc-like rib shapes extending along the outer circumferences of the opening portions 424*a*, 425*a*, and protrude toward a side of the pipe joint 8 to contact an end face of a joint body 8*a*.

The joint body 8*a* of the pipe joint 8 is formed from a No. A6000 family aluminum bare member into a generally elliptical block body by cold forging. Two through holes 8*b*, 8*c* are formed to pass through the joint body 8*a* in the thickness direction (in the crosswise direction in FIG. 7) of the block body. Refrigerant outlet and inlet pipes 8*d*, 8*e* are respectively inserted into the through holes 8*b*, 8*c*, and are retained by the joint body 8*a*. Both pipes 8*d*, 8*e* are formed from No. A6000 family aluminum bare members as well.

In this embodiment, the pipes 8*d*, 8*e* are respectively formed with grooves 8*h*, 8*i* for holding O-rings 8*f*, 8*g* therein at external protruding end portions thereof. The O-rings 8*f*, 8*g* are for sealing connecting portions with counter pipes. The grooves 8*h*, 8*i*, however, complicate the shapes of the pipes 8*d*, 8*e*, and accordingly, it is difficult to integrally form the pipes 8*d*, 8*e* with the joint body 8*a* by cold forging or the like. Therefore, the pipes 8*d*, 8*e* are separately formed from the joint body 8*a*. The joint body 8*a* has two holes 8*j* for attachment.

The joint body 8*a* is, as shown in FIGS. 4, 6, and 7, disposed on the two sub-protruding portions 424, 425.

Specifically, the flat end face of the joint body 8*a* is brought to contact and is joined (brazed) to the base portions 424*b*, 425*b* of the sub-protruding portions 424, 425 in a state where the refrigerant outlet pipe 8*d* communicates with the opening portion 424*a* of the sub-protruding portion 424 and the refrigerant inlet pipe 8*e* communicates with the opening portion 425*a* of the sub-protruding portion 425, respectively.

The front end portions of the pipes 8*d*, 8*e* are brought to contact and joined (brazed) to peripheral portions of the opening portions 424*a*, 425*a* of the sub-protruding portions 424, 425. Thus, the joint body 8*a*, and the pipes 8*d*, 8*e* are respectively integrally brazed to the side plate 42. Therefore, the pipes 8*d*, 8*e* need not be brazed to the joint body 8*a*. In practice, however, when the evaporator 2 is integrally brazed, brazing filler metal invades into clearances between the through holes 8*b*, 8*c* and the pipes 8*d*, 8*e* due to surface tension thereof. The pipes 8*d*, 8*e* consequently are brazed to the joint body 8*a*.

On the other hand, the refrigerant inlet pipe 8*e* of the pipe joint 8 is connected to an outlet side refrigerant pipe of the expansion valve that is not shown. The refrigerant outlet pipe 8*d* is connected to a suction pipe of the compressor that is not shown. The first and second sub-protruding portions 424, 425 enlarge passage areas at approximately right-angled corners provided at portions immediately before and after the pipe joint 8, thereby suppressing an increase in pressure loss.

Next, a manufacturing method of the refrigerant evaporator 1 in this embodiment will be briefly explained. The evaporator 1 is temporarily assembled in the state shown in FIG. 3, and after that is transferred into a brazing furnace while keeping the temporarily assembled state using a specific jig. Then, the temporarily assembled member is heated up to a melting point of brazing filler metal for the aluminum clad members, thereby integrally brazing respective parts of the evaporator 1.

According to the constitution described above in the first embodiment, because the base portions 424*b*, 425*b* composed of rib-like protrusions are formed, joining portions (regions Y1 hatched with slant lines in FIG. 6) at the side of the joint body 8*a* are separated from the joining portions at the side of the refrigerant outlet and inlet pipes 8*d*, 8*e* by steps as joining face interception parts 424*c* that have heights approximately equal to the thickness (for instance, approximately 1 mm) of the side plate 42. Accordingly, brazing filler metal is prevented from moving from the joining portions at the sides of the refrigerant outlet and inlet pipes 8*d*, 8*e* toward the joining portions Y1 at the side of the joint body 8*a*, so that brazing filler metal can be secured at the joining portions at the sides of the outlet and inlet pipes 8*d*, 8*e*. As a result, the brazing property at the sides of the refrigerant outlet and inlet pipes 8*d*, 8*e* are improved, and consequently refrigerant leakage does not occur due to the brazing deficiency at the sides of the refrigerant outlet and inlet pipes 8*d*, 8*e*.

Simultaneously, the joining portions Y1 shown in FIG. 6 can have relatively large areas due to the base portions 424*b*, 425*b*. Accordingly, even if external force is applied to the pipe joint 8 when external pipes are connected to the refrigerant outlet and inlet pipes 8*d*, 8*e*, the pipe joint 8 can have strength resistible to the external force.

In addition, because the base portions 424*b*, 425*b* are formed on the side plate 42 that is formed from the metallic (aluminum) thin plate having a thickness of approximately 1 mm, the base portions 424*b*, 425*b* can be formed when the side plate 42 is formed by pressing. Comparing with the case where the base portions 8*f* are formed on the block body 8*a*, it is not necessary to perform cutting work after cold forging, and the end face of the joint body 8*a* is flat. Therefore, the joint body 8*a* can be formed only by cold forging, resulting in improved workability and low processing cost of the pipe joint 8.

Second Embodiment

Figure 8:
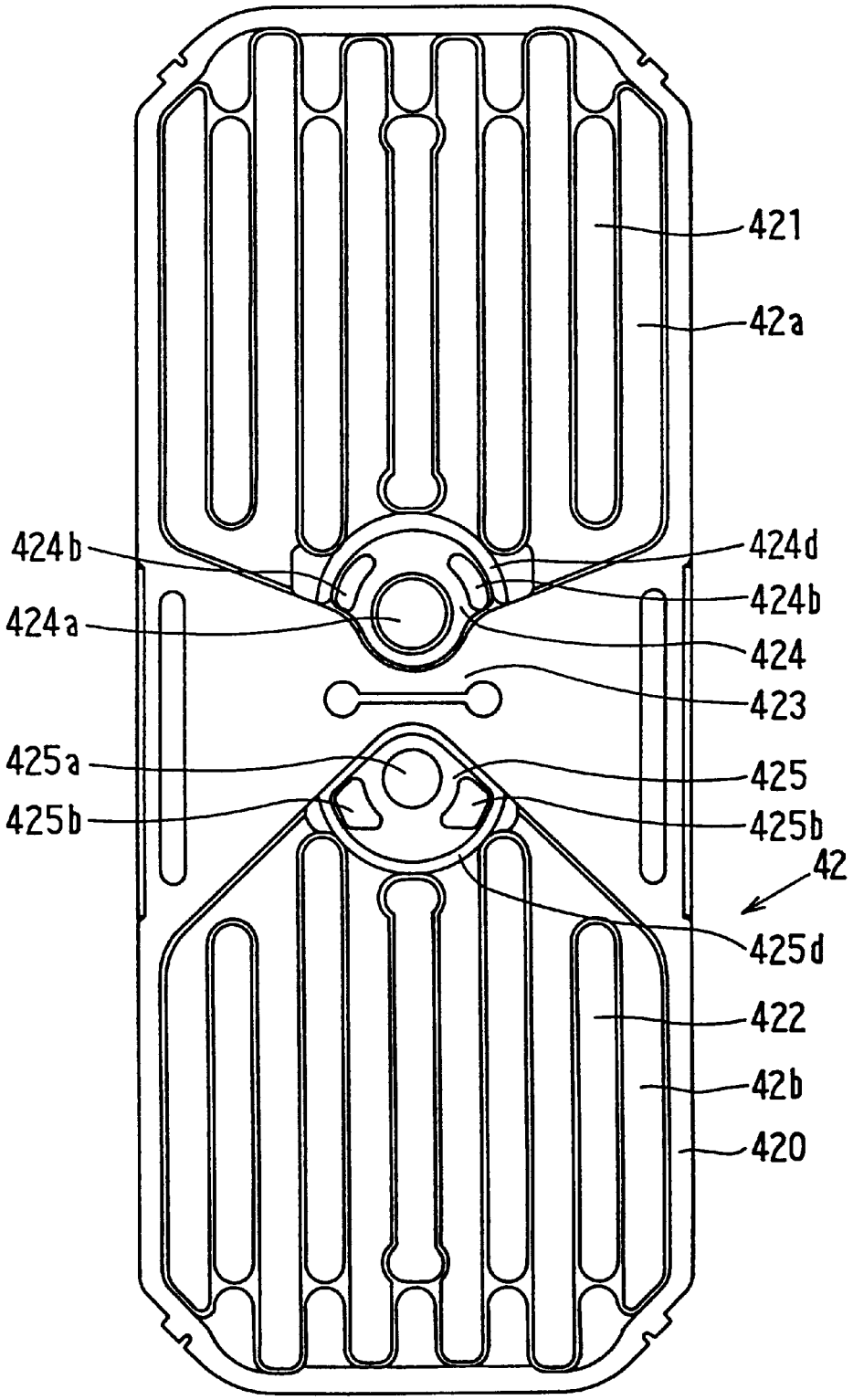
FIG. 8 is a plan view showing a side plate in a second preferred embodiment.

A joining structure in a second preferred embodiment will be explained referring to FIGS. 8 to 10. In the first embodiment, the flat end face of the joint body 8*a* is joined to the base portions 424*b*, 425*b* of the side plate 42. In addition to that, in the second embodiment, protruding portions 424*d*, 425*d* are formed on the side plate 42 at the outer circumference sides of the base portions 424*b*, 425*b* to protrude outwardly (toward the side of the pipe joint 8) more than the base portions 424*b*, 425*b*.

The protruding portions 424*d*, 425*d* have arc-like shapes along the generally semicircular side surfaces on both end portions of the joint body 8*a* in the longitudinal direction, and cover (contact) parts of the side surfaces on the both end portions of the joint body 8*a*. Accordingly, the joining area between the joint body 8*a* and the side plate 42 is increased, resulting in further improved joining strength.

Figure 9:
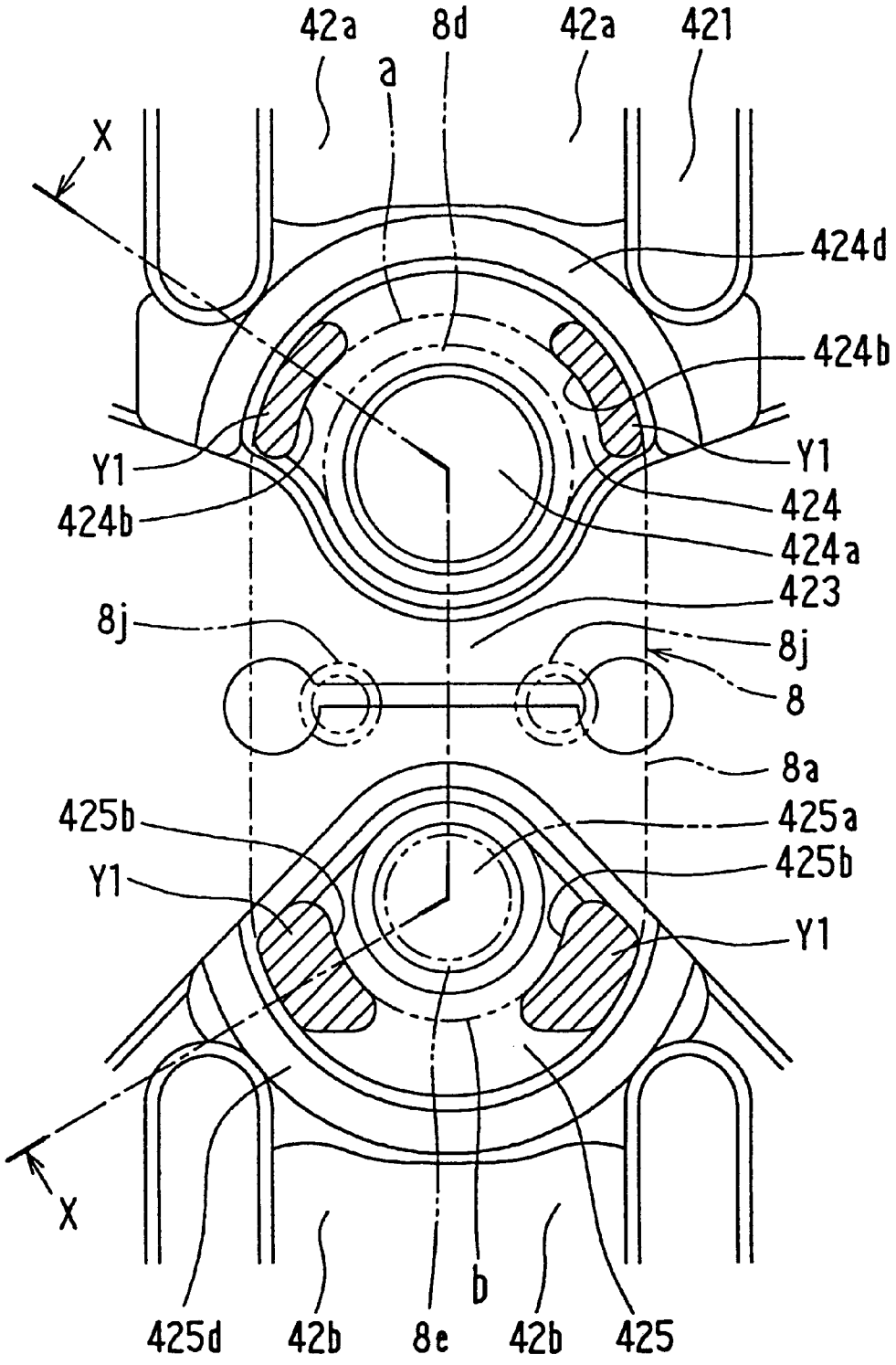
FIG. 9 is a partially enlarged view of the side plate shown in FIG. 8.
Figure 10:
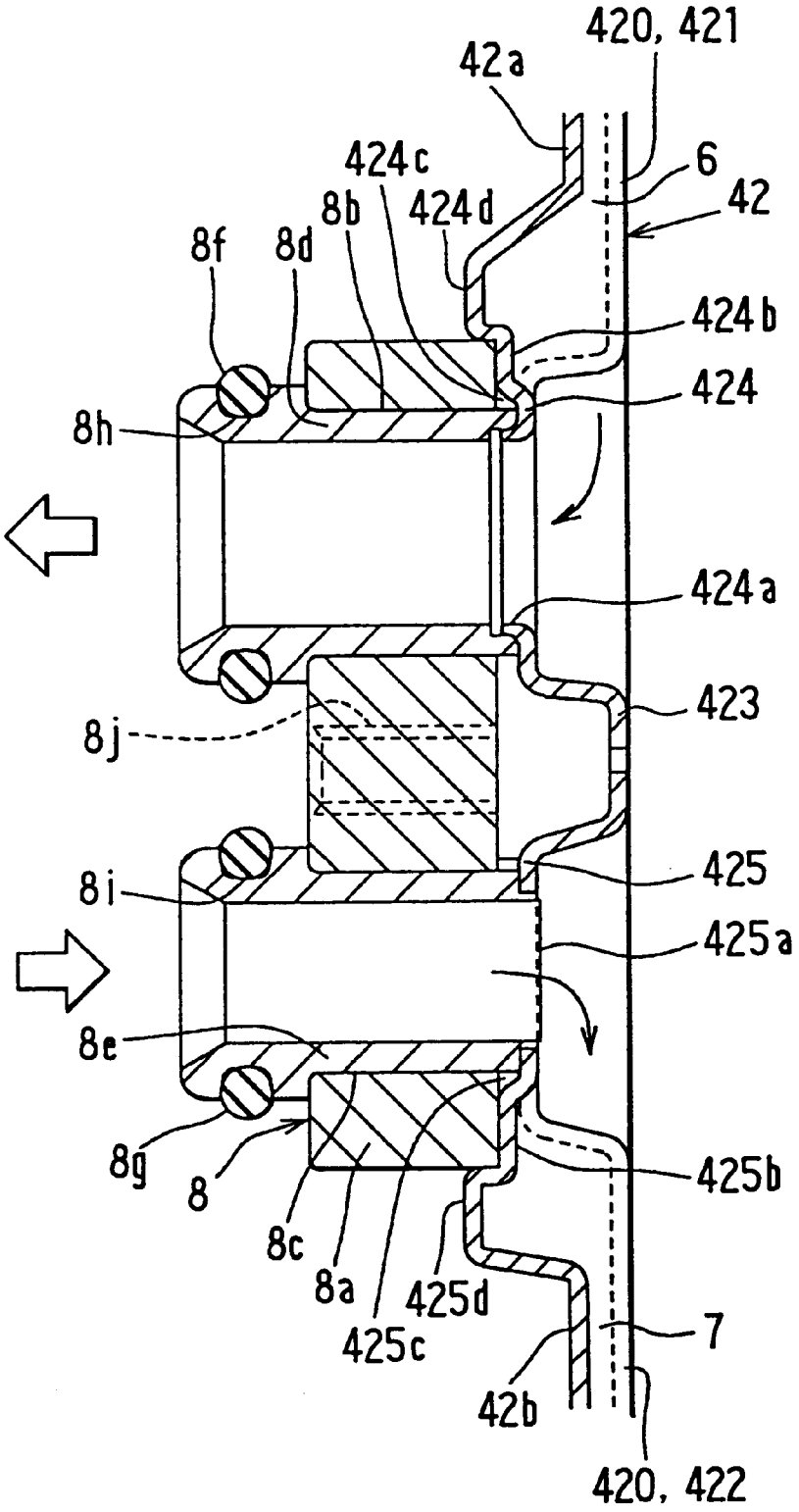
FIG. 10 is a cross-sectional view taken along a X—X line in FIG. 9, showing the side plate and a pipe joint joined to the side plate.

Incidentally, external force is generally applied to the pipe joint 8 in the crosswise direction in FIG. 9 (in the side plate width direction). Therefore, as shown in FIG. 9, it is effective for improving the joining strength in the crosswise direction to dispose the base portions 424*b*, 425*b* at the right and left both sides of the first and second sub-protruding portions 424, 425, respectively. The right and left base portions 424*b*, 424*b* of the first sub-protruding portion 424 and the right and left base portions 425*b*, 425*b* of the second sub-protruding portion 425 may be respectively integrated as continuing base portions as indicated by two-dot chain lines a, b shown in FIG. 9.

Third Embodiment

Figure 11:
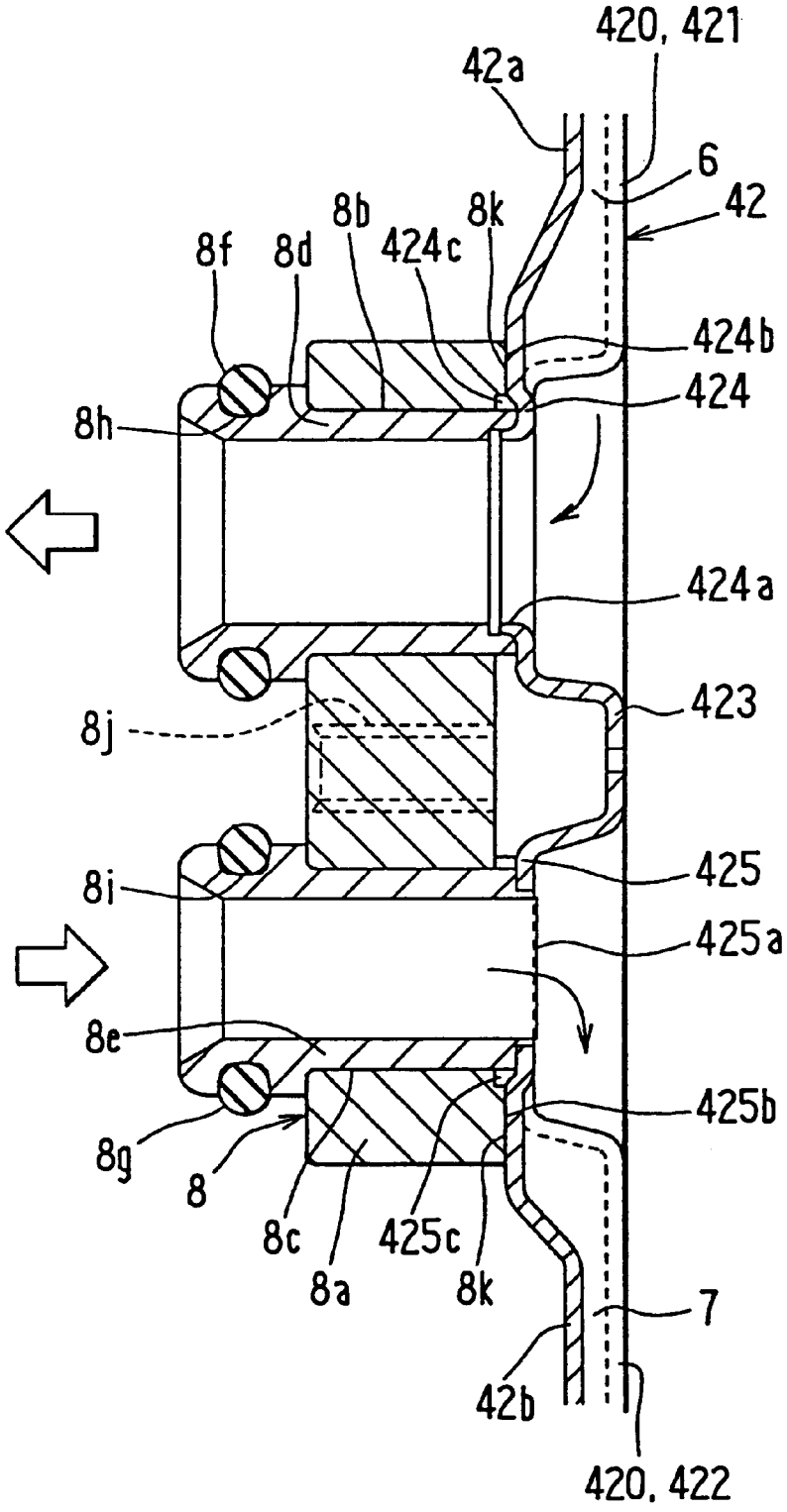
FIG. 11 is a cross-sectional view showing a side plate and a pipe joint joined to the side plate, at a position corresponding to that taken along the VII—VII line in FIG. 6, according to a third preferred embodiment.

A joining structure in a third preferred embodiment will be explained referring to FIG. 11 which corresponds to a cross-section taken along a VII—VII line in FIG. 6. In the third embodiment, the base portions 424*b*, 425*b* are formed to protrude from the first and second sub-protruding portions 424, 425 of the side plate 42, and at the same time, base portions 8*k* are formed at the front end face of the joint body 8*a* to protrude toward the side of the base portions 424*b*, 425*b* and to be joined to the base portions 424*b*, 425*b*.

Figure 12A:
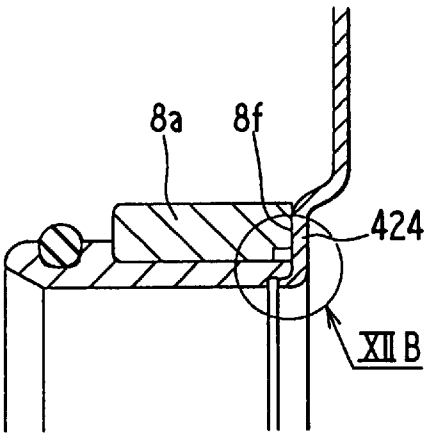
FIG. 12A is a cross-sectional view for explaining a feature in the third embodiment.
Figure 12B:
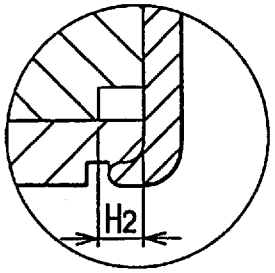
FIG. 12B is an enlarged view of a circled portion XIIB in FIG. 12A.
Figure 13A:
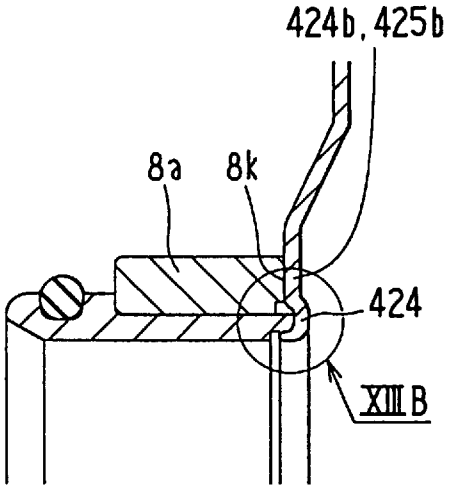
FIG. 13A is a cross-sectional view for explaining the feature in the third embodiment.
Figure 13B:
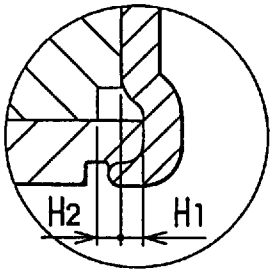
FIG. 13B is an enlarged view of a circled portion XIIIB in FIG. 13A.
Figure 14A:
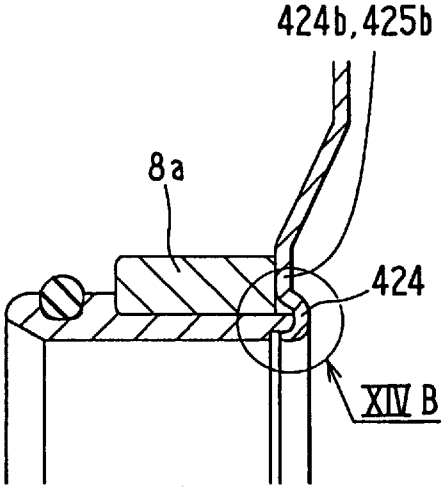
FIG. 14A is a cross-sectional view for explaining a feature in the third embodiment.
Figure 14B:
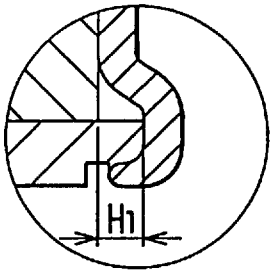
FIG. 14B is an enlarged view of a circled portion XIVB in FIG. 14A.

According to the third embodiment described above, because both the side plate 42 and the joint body 8*a* have the protruding portions 424*d*, 425*d*, and 8*k*, respectively, protruding heights $H_1$, $H_2$ of the base portions 424*b*, 425*b*, and 8*k* can be decreased as follows. That is, in a structure (the prototype structure of FIG. 2) shown in FIGS. 12A and 12B, it is necessary for the base portion 8*f* to have the protruding height $H_2$ of approximately 1.5 mm. To the contrary, according to the third embodiment, as shown in FIGS. 13A and 13B, the protruding height $H_2$ of the respective base portions 8*k* can be decreased to approximately 0.75 mm that is an approximately half of that shown in FIGS. 12A and 12B. Further, in the first embodiment shown in FIGS. 14A and 14B, it is necessary for the base portions 424*b*, 425*b* to have the protruding height $H_1$ of approximately 1.5 mm. To the contrary, according to the third embodiment, the protruding height $H_1$ of the base portions 424*b*, 425*b* can be decreased to approximately 0.75 mm that is an approximately half of that shown in FIGS. 14A and 14B.

Thus, the protruding height $H_1$ of the base portions 424*b*, 425*b* at the side plate side and the protruding height $H_2$ of the base portions 8*k* at the joint body side can be decreased to the half dimensions, respectively. This makes possible to form base portions 8*k* of the joint body 8*a* by cold forging. Further, concerning the side plate 42, a plastic deformation amount (processing degree) of the plate as a whole is decreased due to the decrease in the protruding height $H_1$ of the respective base portions 424*b*, 425*b*, resulting in improvement of workability of the side plate 42 at pressing.

(Fourth Embodiment)

Figure 15:
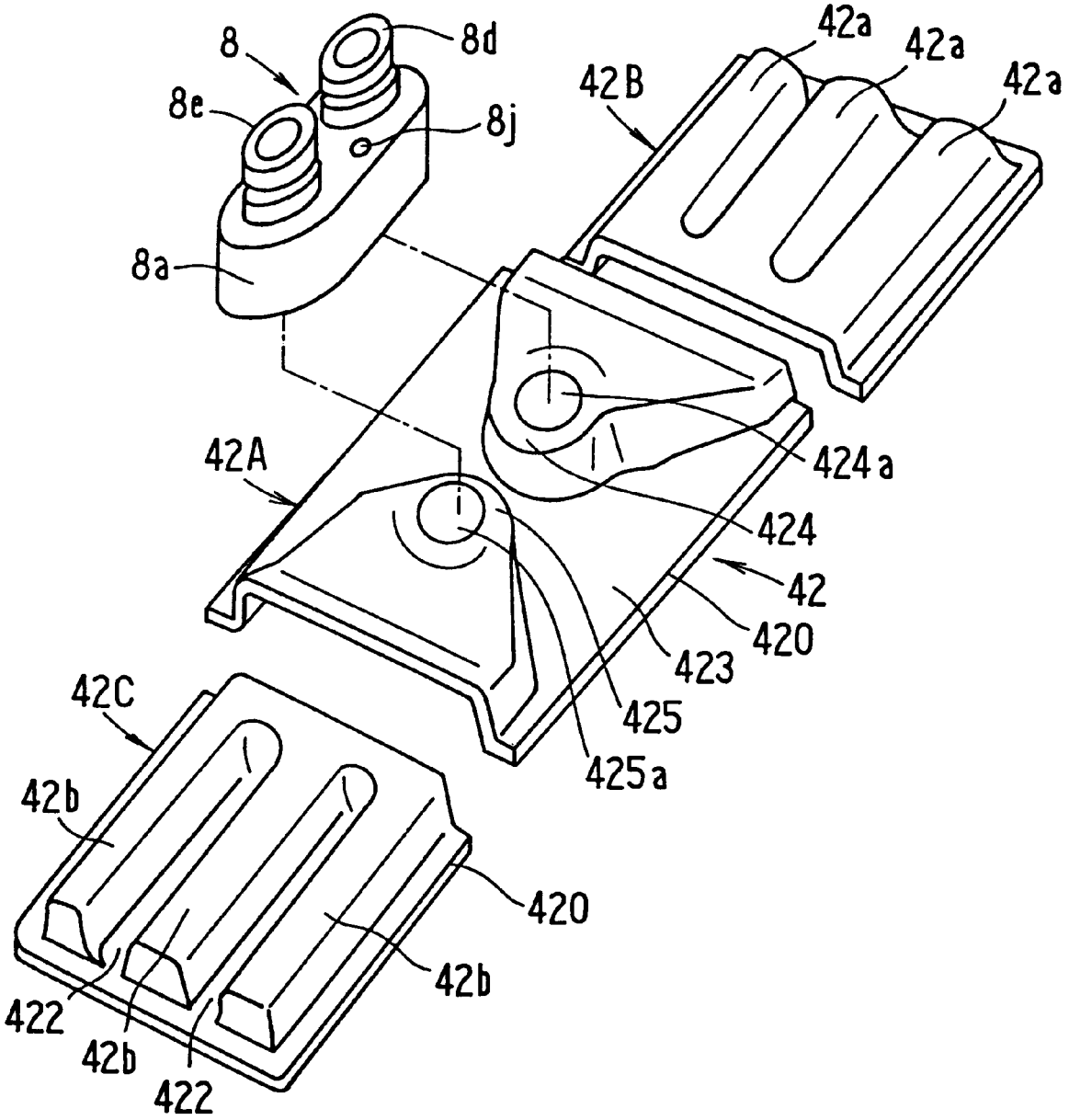
FIG. 15 is exploded perspective view showing a side plate and a pipe joint in a fourth preferred embodiment.

A joining structure in a fourth preferred embodiment will be explained referring to FIG. 15. In the fourth embodiment, the side plate 42 is divided into first, second, and third members 42A, 42B, 42C. The first member 42A is to be joined to the pipe joint 8, the second member 42B has the protruding portion 42*a* for defining the side refrigerant outlet passage 6, and the third member 42C has the protruding portion 42*b* for defining the side refrigerant inlet passage 7.

Because the first member 42A is joined to the pipe joint 8, the strength of the first member 42A needs to be enhanced. On the other hand, the second and third members 42B, 42C are for forming the refrigerant passages 6, 7, and do not directly receive external force. Therefore, the first member 42A has a thickness (for instance, approximately 1.2 mm) that is larger than that (for instance, approximately 1 mm) of the second and third members 42B, 42C. As a result, the first member 42A has a sufficient joining strength to the pipe joint 8.

Instead of increasing the thickness of the first member 42A more than that of the second and third members 42B, 42C, the first member 42A may be made of high strength material having a strength more than that of the second and third members 42B, 42C. For instance, BA10PC-O can be used as the high strength material for the first member 42A, while BA10PC-H14 can be used as material, which has strength smaller than that of the first member 42A, for the second and third members 42B, 42C.

According to the fourth embodiment, the strength of the first member 42A is enhanced more than that of the second and third members 42B, 42C by appropriately selecting at least one of the thickness and the material thereof. As a result, the joining strength (breakage strength) between the first member 42A and the pipe joint 8 is improved. Accordingly, it is not always necessary to form the base portions 424*b*, 425*b* and the protruding portions 424*d*, 425*d* as in the first and second embodiments. However, if necessary, the base portions 424*b*, 425*b*, and the protruding portions 424*d*, 425*d* in the first and second embodiments can be combined with the constitution in the fourth embodiment. Further, in the fourth embodiment, the countermeasure of increasing the thickness of the first member 42A more than that of the second and third members 42B, 42C may be combined with the countermeasure of forming the first member 42A from the material having the strength larger than that of the second and third members 42B, 42C.

While the present invention has been shown and described with reference to the foregoing preferred embodiments, it will be apparent to those skilled in the art that changes in form and detail may be made therein without departing from the scope of the invention as defined in the appended claims.

Figure 16:
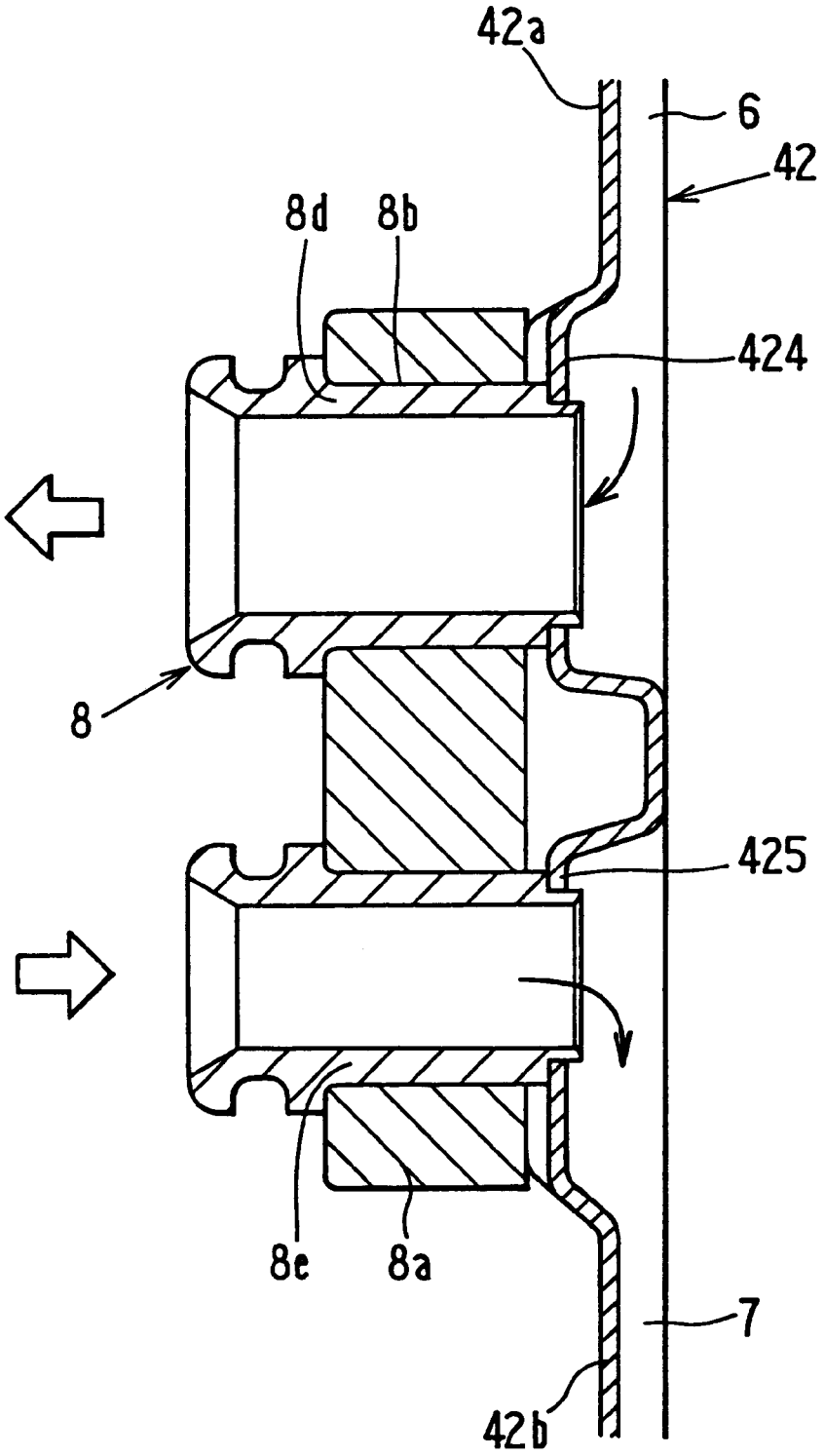
FIG. 16 is a cross-sectional view showing a side plate and a pipe joint attached to the side plate in a modified embodiment.
Figure 17:
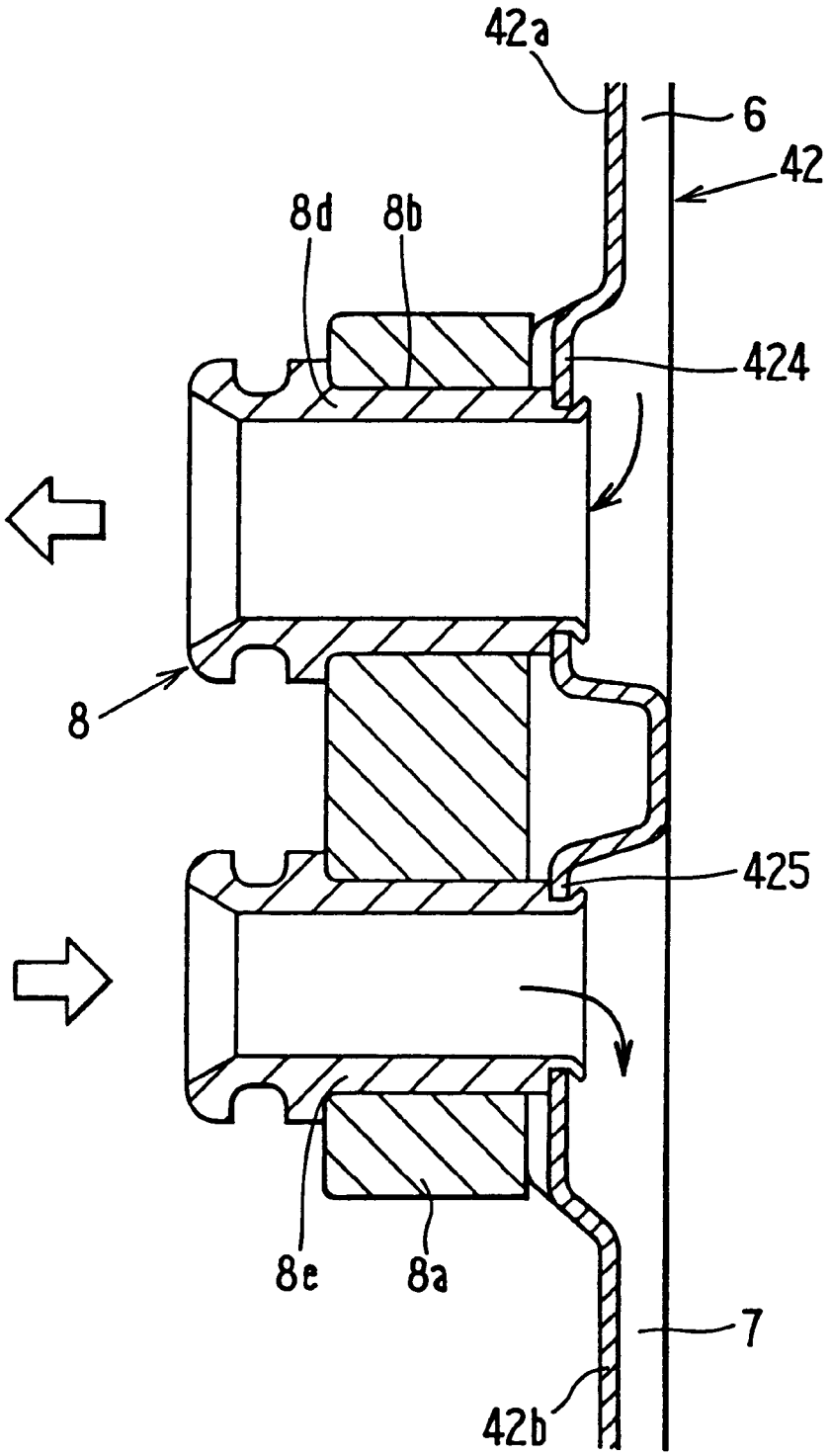
FIG. 17 is a cross-sectional view showing a side plate and a pipe joint attached to the side plate in another modified embodiment.

For instance, in the first to third embodiments described above, as shown in FIGS. 7, 10, and 11, the outlet and inlet pipes 8*d*, 8*e* of the pipe joint 8 do not protrude into the side refrigerant outlet and inlet passages 6, 7; however, as shown in FIG. 16, the outlet and inlet pipes 8*d*, 8*e* may be protrude into the side refrigerant outlet and inlet passages 6, 7, respectively. Further, the protruding portions of the outlet and inlet pipes 8*d*, 8*e* may be caulked as shown in FIG. 17. Accordingly, the outlet and inlet pipes 8*d*, 8*e* can be more steadily fixed to the side plate 42.

In the first to fourth embodiments, the pipe joint 8 is composed of the joint body 8*a*, and the outlet and inlet pipes 8*d*, 8*e*, which are integrated with the joint body 8*a* by being inserted into the through holes 8*b*, 8*c* of the joint body 8*a*. However, when the outlet and inlet pipes 8*d*, 8*e* have simple configurations, the outlet and inlet pipes 8*d*, 8*e* may be integrally formed with the joint body 8*a* by cold forging using aluminum or the like. It is apparent that the present invention can be applied to such a pipe joint 8.

What is claimed is:

1. A lamination type heat exchanger comprising:

a plurality of pairs of metallic thin plates laminated with one another for forming a plurality of fluid passages therein, in which an inside fluid flows for exchanging heat with an outside fluid flowing outside the plurality of fluid passages, the plurality of fluid passages respectively having inlet and outlet portions of the inside fluid, the plurality of pairs of metallic thin plates including an end plate that is disposed at an end in a lamination direction of the plurality of pairs of metallic thin plates;

a side plate joined to the end plate, and having first and second protruding portions for forming a side outlet passage and a side inlet passage with an end plate, the side outlet passage communicating with the outlet portions of the plurality of fluid passages, the side inlet passage communicating with the inlet portions of the plurality of fluid passages, the first and second protruding portions having first and second base portions embossing from the first and second protruding portions toward an opposite side of the end plate in the lamination direction; and a pipe joint including a fluid outlet that communicates with the side outlet passage and a fluid inlet that communicates with the side inlet passage, and having an end face that is joined to the first and second base portions of the side plate; wherein:

the first and second protruding portions of the side plate has first and second opening portions for communicating with the fluid outlet and the fluid inlet of the pipe joint, first and second peripheral portions respectively surrounding the first and second opening portions, and the first and second base portions respectively provided around the first and second peripheral portions; and the first and second base portions protrude in the opposite direction of the end plate more than the first and second peripheral portions, respectively.

2. The lamination type heat exchanger of claim 1, wherein at least one of the first and second protruding portions of the side plate has a secondary protruding portion protruding more than the first and second base portions to contact a side face of the pipe joint.

3. The lamination type heat exchanger of claim 1, wherein the end face of the pipe joint is flat.

4. The lamination type heat exchanger of claim 1, wherein the pipe joint comprising:

a joint body joined to the first and second base portions of the side plate and having first and second through holes;

an outlet pipe having the fluid outlet therein, inserted into the first through hole of the joint body, and joined to the first peripheral portion of the side plate denting than the first base portion; and an inlet pipe having the fluid inlet therein, inserted into the second through hole of the joint body, and joined to the second peripheral portion of the side plate denting than the second base portion.

5. A lamination type heat exchanger comprising:

a plurality of pairs of metallic thin plates laminated with one another for forming a plurality of fluid passages therein, in which an inside fluid flows for exchanging heat with an outside fluid flowing outside the plurality of fluid passages, the plurality of fluid passages respectively having inlet and outlet portions of the inside fluid, the plurality of pairs of metallic thin plates including and end plate that is disposed at an end in a lamination direction of the plurality of pairs of metallic thin plates;

a side plate joined to the end plate, and having first and second protruding portions for forming with the end plate a side outlet passage and a side inlet passage respectively communicating with the outlet and inlet portions of the plurality of fluid passages, the first and second protruding portions having first and second opening portions; and a pipe joint including a joint body that has first and second through holes therein and is joined to a first joining region of the side plate, and outlet and inlet pipes respectively inserted into the first and second through holes to protrude from the first and second through holes at ends thereof and to communicate with the first and second opening portions of the side plate, the outlet and inlet pipes being joined to second and third joining regions of the first and second protruding portions of the side plate, the second and third joining regions being non-coplanar with the first joining region; wherein:

the first joining region includes a first part that is provided on the first protruding portion around the second joining region, and a second part that is provided on the second protruding portion around the third joining region; and the first and second parts of the first joining region protrude in an opposite direction of the end plate more than the second and third joining regions.

6. A lamination type heat exchanger comprising:

a plurality of pairs of metallic thin plates laminated with one another for forming a plurality of fluid passages therein, in which an inside fluid flows for exchanging heat with an outside fluid flowing outside the plurality of fluid passages, the plurality of fluid passages respectively having inlet and outlet portions of the inside fluid, the plurality of pairs of metallic thin plates including an end plate that is disposed at an end in a lamination direction of the plurality of pairs of metallic thin plates;

a side plate joined to the end plate, and having first and second protruding portions for forming a side outlet passage and a side inlet passage with the end plate, the side outlet passage communicating with the outlet portions of the plurality of fluid passages, the side inlet passage communicating with the inlet portions of the plurality of fluid passages, the first and second protruding portions having first and second base portions embossing from the first and second protruding portions toward an opposite side of the end plate in the lamination direction; and a pipe joint including a fluid outlet that communicates with the side outlet passage and a fluid inlet that communicates with the side inlet passage, and having an end face that is joined to the first and second base portions of the side plate; wherein:

at least one of the first and second protruding portions of the side plate has a secondary protruding portion protruding more than the first and second base portions to contact a side face of the pipe joint.

* * * * *